United States Patent [19]

Robinson, Jr.

[11] 4,432,438

[45] Feb. 21, 1984

[54] UPRIGHT FOR LIFT TRUCK

[75] Inventor: Richard H. Robinson, Jr., Kalamazoo, Mich.

[73] Assignee: Clark Equipment Company, Buchanan, Mich.

[21] Appl. No.: 232,493

[22] Filed: Feb. 9, 1981

Related U.S. Application Data

[63] Continuation-in-part of Ser. No. 232,762, Feb. 9, 1981.

[51] Int. Cl.[3] ..... B66B 9/20

[52] U.S. Cl. ..... 187/9 E; 414/631

[58] Field of Search ..... 187/9 E, 9 R; 414/629, 414/631, 641, 635, 785; 254/89 H, 93 R

[56] References Cited

U.S. PATENT DOCUMENTS

| | | | |
|---|---|---|---|
| 2,788,863 | 4/1957 | Ulinski | 187/9 R |
| 3,360,078 | 12/1967 | Hopfeld | 187/9 R |
| 3,394,778 | 7/1968 | Brinton | 187/9 E |
| 3,830,342 | 8/1974 | Allen | 187/9 R |
| 4,030,568 | 6/1977 | Heinold | 187/9 E |

FOREIGN PATENT DOCUMENTS

| | | |
|---|---|---|
| 1807169 | 9/1969 | Fed. Rep. of Germany . |
| 2020276 | 4/1970 | Fed. Rep. of Germany . |
| 2926657 | 1/1981 | Fed. Rep. of Germany . |
| 2053153A | 2/1981 | United Kingdom . |

*Primary Examiner*—Joseph J. Rolla
*Assistant Examiner*—Kenneth Noland
*Attorney, Agent, or Firm*—John C. Wiessler

[57] ABSTRACT

A four-stage upright having a fixed upright section, three telescopic upright sections, and a load carrier mounted on the inner telescopic section includes a first asymmetric lift cylinder assembly located in the upright off-center and adjacent to one side of the upright and a second asymmetric lift cylinder assembly mounted in the upright off-center and adjacent to the opposite side of the upright. The first cylinder assembly is supported from one of the telescopic upright sections and is operatively connected to the load carrier, while the second lift cylinder assembly is supported from the fixed upright section and is operatively connected to the three telescopic upright sections. The first cylinder assembly is, when collapsed, approximately one-half the height of the collapsed upright, and the second cylinder assembly is, when collapsed, approximately equal to the height of the collapsed upright. A unique balancing system is implemented in the combination of cylinder locations and respective reeving of lifting chains which maintains a substantial balance of force-moments in a transverse plane of the upright.

32 Claims, 9 Drawing Figures

UPRIGHT FOR LIFT TRUCK

CROSS-REFERENCE TO RELATED APPLICATION

This application is a continuation-in-part of co-pending application Ser. No. 232,762, filed Feb. 9, 1981 and now issued.

BACKGROUND OF THE INVENTION

One of the most persistent problems encountered in the industrial truck art over the years has been to provide an upright construction which affords the operator of the truck good visibility through the upright, particularly in quadstage uprights.

Heretofore various means have been devised for improving operator visibility through multi-stage uprights of lift trucks while maintaining relatively simple and low cost construction. Previous attempts have included upright structures such as are disclosed in U.S. Pat. Nos. 2,788,863, 3,360,078, 3,394,778, 3,830,342 and 4,030,568. German Pat. No. 1,807,169 and German Publication (Offlegunschrifft) No. 2,020,276. In addition U.S. Patent applications Ser. Nos. 202,099 and 176,742 filed Oct. 30, 1980 and Aug. 11, 1980, respectively, and which have U.S. Pat. Nos. 4,374,550 and 4,401,191, respectively and, which are continuations of Ser. Nos. 17,779 and 28,291, filed Mar. 8, 1979 and Apr. 9, 1979, respectively, and which are both abandoned and both in the name of Richard J. Bartow, common assignee, disclose prior art of interest. Also, Ser. No. 17,779 is a continuation-in-part application of Ser. No. 842,765, filed Oct. 17, 1977 and also abandoned.

SUMMARY

My invention is an improvement over any known prior upright structure for a lift truck which is designed to provide good operator visibility through the upright. My invention provides an upright of relative simplicity and low cost of structure for uprights having four or more stages. I provide in such a multi-stage upright two asymmetric lift cylinder assemblies located on opposite sides of the central vertical longitudinal plane of the upright which are independently reeved by sprocket and chain means to elevate both a load carriage and telescopic sections of the upright. Both cylinder assemblies are mounted such that they are operatively connected to different ones of the upright elements comprising the load carriage and telescopic sections in a manner which provides good visibility through the upright and which minimizes the need for reeving of hydraulic conduits in the upright as has been required heretofore in uprights of the type contemplated in order to conduct hydraulic pressure fluid to a primary cylinder assembly which ordinarily has been elevated with the inner telescopic section during upright operation. The lifting system is designed to provide an upright assembly which is in substantial force-moment equilibrium in transverse planes of the upright.

A primary object of the invention is to provide an improved multi-stage upright structure for lift trucks in which good operator visibility is provided through the upright, and which minimizes the requirement heretofore of reeving hydraulic conduit in such upright structures.

It is an important principle of the invention to provide an essentially balanced upright which utilizes twin asymmetric cylinder assemblies for elevating different upright elements.

It is an important feature of the invention that one of the cylinder assemblies is supported from a telescopic upright section other than the section which is adapted to be actuated to maximum elevation.

Other objects, features and advantages of the invention will readily appear to persons skilled in the art from the detailed description of the invention which follows.

DESCRIPTION OF PREFERRED EMBODIMENT

Figure 1:
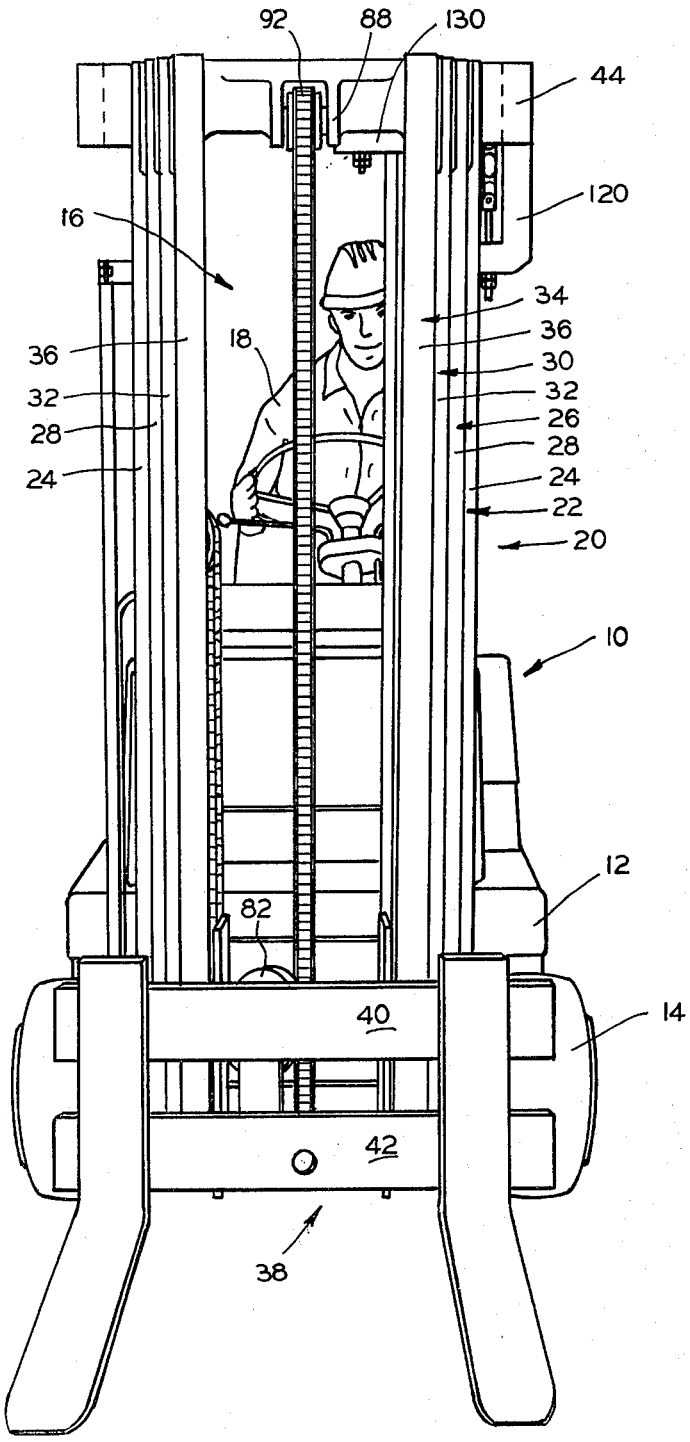
FIG. 1 is a front perspective view of an industrial lift truck which embodies the invention; it shows a load carriage lowered to the bottom of retracted telescopic upright sections of a four-stage upright and exemplifies the improved operator visibility which is provided through the upright.

Referring to the drawing, a conventional industrial lift truck is shown at numeral 10 in FIG. 1 having a frame and body construction 12 mounted on a pair of steer wheels at the rear end thereof, not shown, and a pair of traction wheels 14 forwardly thereof. It embodies suitable power components for operating the truck from an operator's compartment 16. An operator is illustrated at numeral 18 in a normal position and attitude and as he would appear when operating the truck to an observer in front of the truck.

The upright assembly of the present invention is illustrated generally at numeral 20, the assembly being mounted on the truck in known manner. A fixed mast section 22 includes a pair of transversely spaced opposed channel members 24 arranged to receive a first telescopic mast section 26 formed of two laterally spaced I-beams 28, which is in turn arranged to receive a second telescopic mast section 30 formed of two laterally spaced I-beams 32, which is in turn arranged to receive a third telescopic mast section 34 formed of two laterally spaced I-beams 36, the mast sections 26, 30 and 34 being guide roller supported in mast sections 22, 26 and 30, respectively, in known manner, and arranged for longitudinally telescoping movement relative to each other. A load or fork carriage 38 having a pair of transverse support plates 40 and 42 is guide roller mounted in known manner for elevation in the upright section 34.

Mast section 22 is cross-braced for rigidity by means of upper and lower transverse brace members 44 and 46, first intermediate telescopic section 26 is cross-braced by upper and lower transverse members 48 and 50, second intermediate telescopic section 30 is cross-braced by upper and lower transverse members 52 and 54, and inner telescopic section 34 is cross-braced by upper and lower transverse members 56 and 58.

Figure 4:
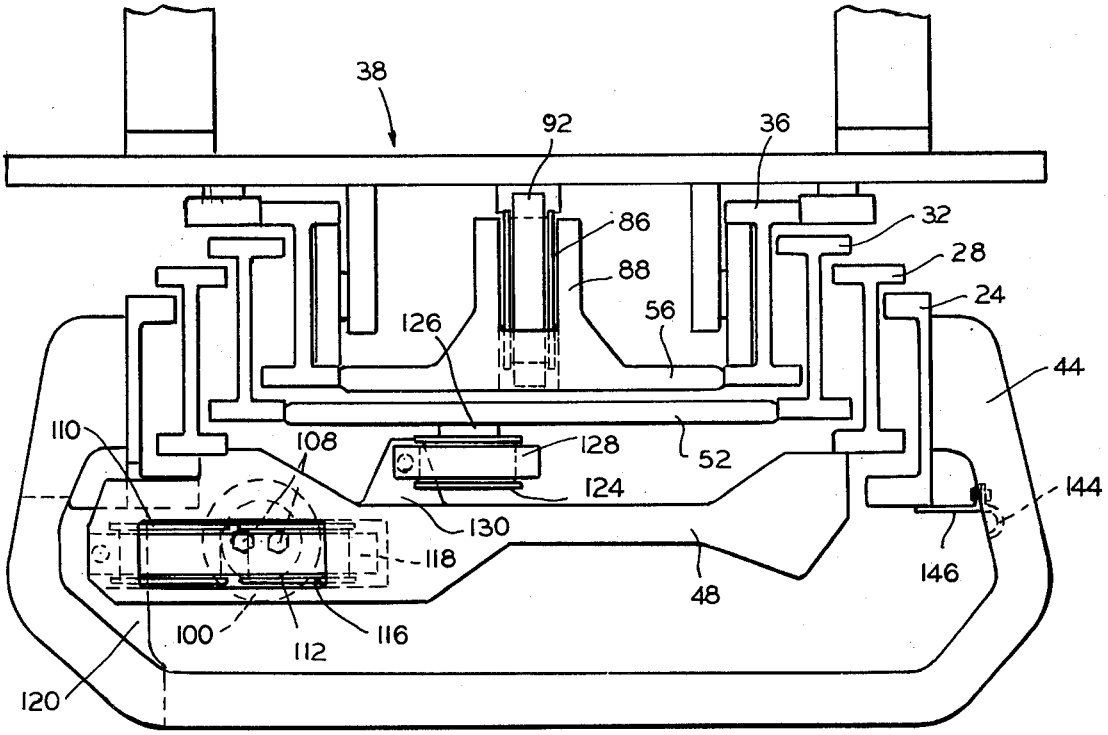
FIG. 4 is a plan view of the upright shown in FIG. 3.
Figure 5:
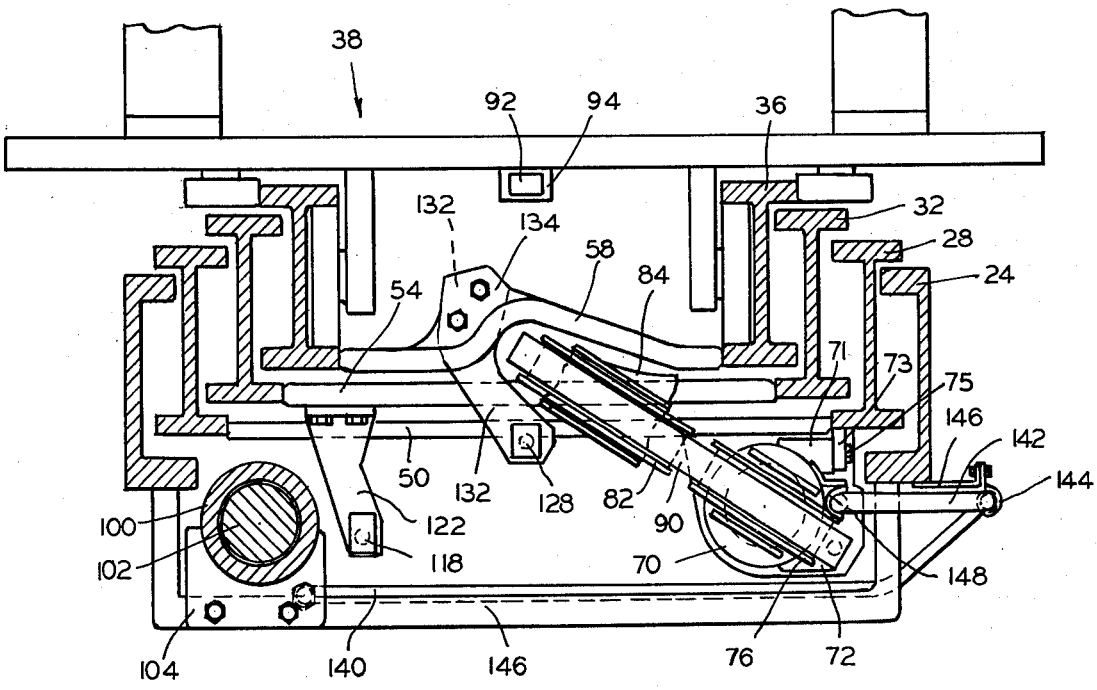
FIG. 5 is a sectional view taken along line 5—5 of FIG. 3.

The pairs of I-beam rails of each of the telescopic upright sections 34, 30 and 26 are nested in known manner within the next outer upright section 30, 26 and 22, respectively, with respective front and rear flanges of the pairs of I-beams of each section interlocking with the respective adjacent upright sections as shown in FIGS. 4 and 5. Pairs of guide and support rollers, not shown, are suitably mounted in known manner between each adjacent pair of I-beam and channel rails of the various upright sections for supporting each telescopic section longitudinally and laterally for extensible movement as best shown in FIG. 6.

A primary cantilevered asymmetric lift cylinder assembly 70 is supported adjacent one side of the upright assembly at least partially behind the assembly of rail sections on that side of the upright. A chain anchor block 72 may be welded to the upper outside surface of the cylinder. The bottom of the cylinder is secured to a platform member 74 which in turn is secured to transverse brace 50 of said telescopic section. A block member 73 is welded to the adjacent rear flange of the one rail member 28 in position to be secured to a bracket 71, welded to the cylinder adjacent the upper end thereof by registrable studs 75. A single sprocket 76 is mounted in known manner by a bracket 78 at the end of a piston rod 80. A second sprocket 82 is mounted in a similar bracket 84 which has a base straddling and secured to the surfaces of brace member 54 of second telescopic section 30, sprockets 76 and 82 being mounted, as shown, on a bias to the transverse plane of the upright and in longitudinal rotating alignment one with the other. A third sprocket 86 is operative with sprockets 76 and 82 and is supported from upper support brace 56 of mast section 34 for rotation about a transverse axis on a stub shaft which is supported from a forwardly extending bifurcated portion 88 of brace 56.

A chain means 90,92 has its one end secured at chain anchor 72 and its opposite end secured at a chain anchor 94 on load carriage support plate 42, the chain means being reeved between the chain anchors and inside the upright assembly on sprockets 76, 82 and 86. A "twist" or swivel chain link coupling 96 (see FIG. 7) connects the one end of chain portion 90 to the adjacent one end of chain portion 92 so that the chain portions may operate in different planes relative to the upright; i.e., chain portion 92 operates in a plane longitudinal of the upright and chain portion 90 operates in a bias plane intermediate the longitudinal and transverse planes of the upright as best shown in FIG. 5.

Figure 6:
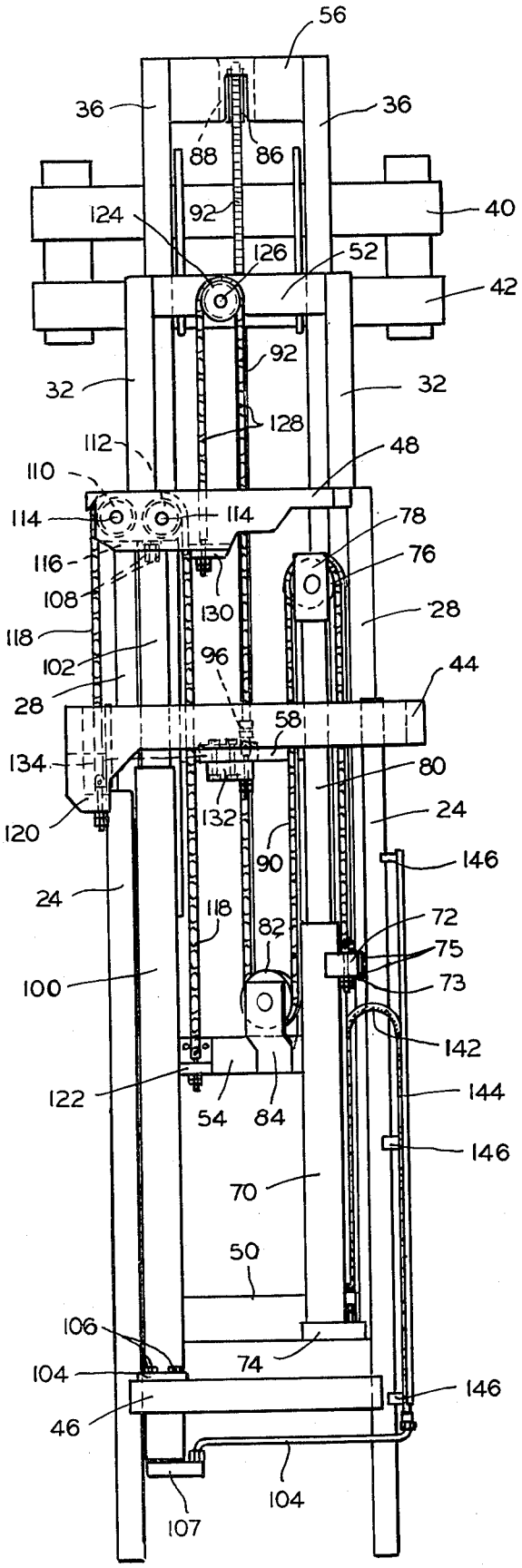
FIG. 6 is a full rear view reduced in scale to show the upright partially extended.

The retracted height of cylinder assembly 70 is substantially less than the collapsed height of the upright assembly 20; it is adapted to elevate load carriage 38 on inner upright section 34 to a nearly full free-lift position at full extension of piston rod 80 as shown in FIG. 6. The particulars of the representative upright design shown locates the swivel coupling 96 between sprockets 82 and 86 such that a full free-lift position of carrige 38 with extension of piston rod 80 substantially to the height of the collapsed upright, all as is well known in upright design, is not possible. However, it would be feasible in an upright having different specifications.

A second asymmetric cylinder assembly 100 having a piston rod 102 is located at the side of the upright assembly opposite the location of cylinder assembly 70 so that preferably it lies wholly or at least partially behind the assembled rails on that side of the upright, it being also supported adjacent its lower end from fixed upright section brace member 46 by a bracket 104 and studs 106, a base member 107 being connected to the bottom of the cylinder, and being supported at its upper end by the piston rod end being secured directly to support brace 48 by a pair of studs 108. A pair of sprockets 110,112 are supported for aligned rotation in the transverse plane of the upright by a pair of stub shafts 114 within an opening 116 formed inside of transverse brace member 48, the sprockets being rotatable on parallel axes substantially longitudinally of the lift truck, i.e., in a plane which is substantially normal to the plane of rotation of sprocket 86. A lifting chain 118 is reeved on sprockets 110,112 and is connected at one end to an anchor block 120 at a distance substantially outwardly of the one side of cylinder 100. Block 120 is a portion of the one end of outer fixed transverse brace 44. Chain 118 is connected at the other end to an anchor block 122 which is secured to transverse bar 54 of second intermediate upright section 30. A sprocket 124 is mounted for rotation on a stub shaft 126 which is secured to transverse brace 52 and is adapted to operate in the space formed between transverse braces 48 and 52 for elevation with second intermediate upright section 30. A chain 128 is anchored at its outer end to an anchor block 130 which is secured to and extends forwardly of transverse brace 48, the inner end of chain 128 being secured to an anchor block 132 which is secured beneath a forwardly extending support member of transverse brace 58 on inner upright section 34 and which extends therefrom rearwardly and inwardly as best shown in FIGS. 5 and 6.

Figure 3:
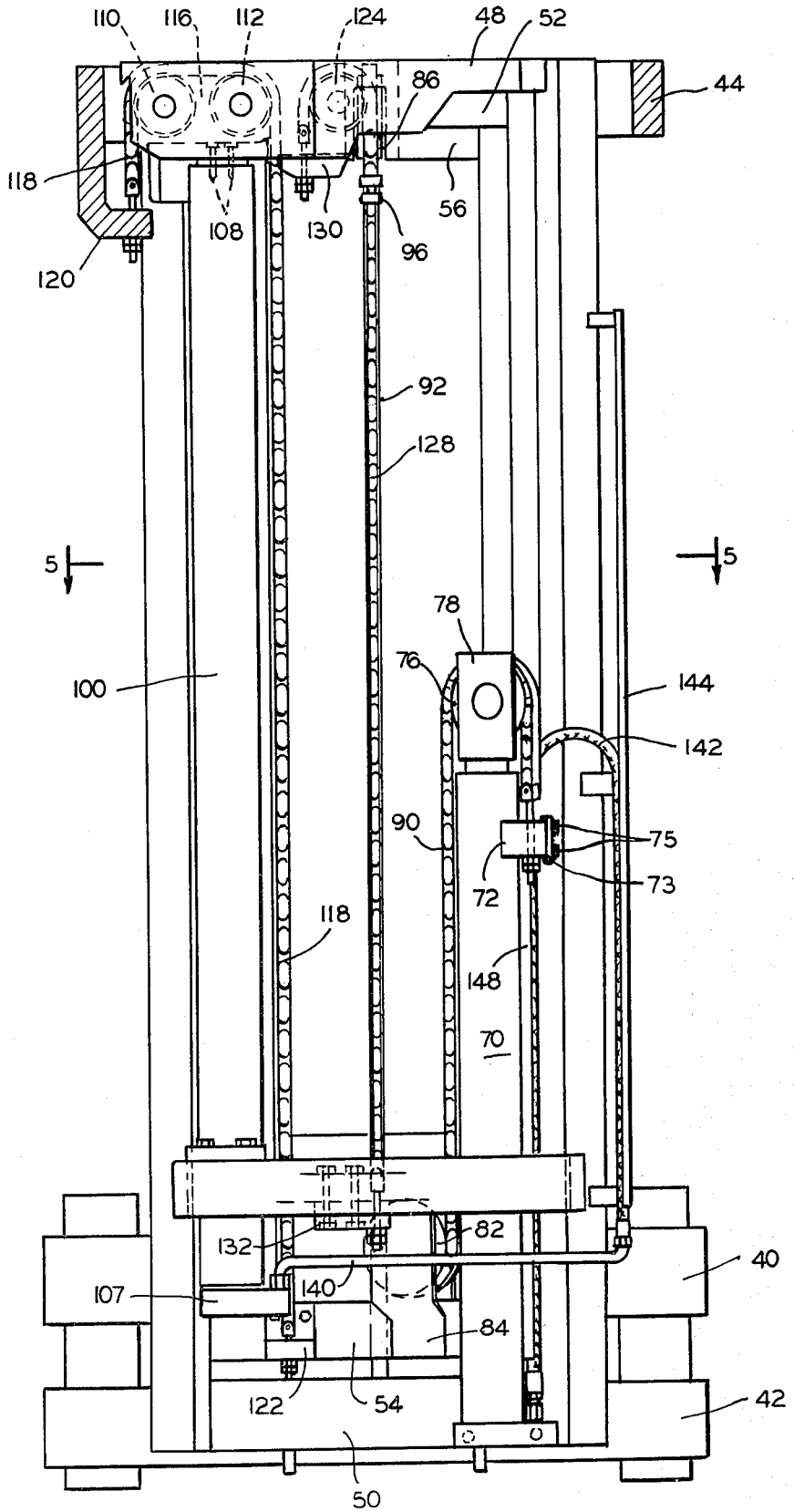
FIG. 3 is an enlarged full rear view of the upright shown in FIG. 1 with the upright dismounted from the truck.

Base members 74 and 107 of the cylinders 70 and 100 are connected together hydraulically by a rigid conduit 140 and a flexible conduit 142 which is adapted to be raised and lowered at its inner end with cylinder 70 on the first intermediate upright section and is guided along its outer length by an elongated open channel member 144 connected to fixed upright section 22 by three brackets 146, and supported along its inner portion by a similar elongated channel member 148 secured to the side of the cylinder 70. As is well known, during upright extension, as between the positions thereof in FIG. 3 and FIG. 6 and thence to maximum elevation, the conduit 142 transfers a portion of its length from support in guide channel 148 to channel 144, and vice versa on retraction of the upright, as cylinder assembly 70 is elevated with upright section 26 by cylinder assembly 100.

An important feature of my invention is the concept of twin asymmetric cylinders as applied to a four-stage upright in which the primary cylinder assembly 70 is mounted not only at one side of the upright substantially out of the operator's visibility window through the upright, but is also mounted on the first telescopic upright section rather than as heretofore on the inner upright section thereby minimizing the added structure, complexity and cost of reeving hydraulic conduit in the upright. That is, the relatively short and easily mounted flexible conduit 142 in the readily accessible location at one side of the upright, combined with rigid conduit portion 140, comprises the total hydraulic conduit required in the upright to operate the upright of my invention.

It will be observed that the upright design is such that at any given stage of extensions or retraction thereof the interior or central vertical portions of chains 90, 92 and 128 are at all times located in substantial alignment one with another in substantially the central vertical longitudinal plane of the upright, thereby minimizing interference with operator visibility through the upright by such interior chain portions substantially to the width of the widest single chain as seen, for example, in FIGS. 1, 3, 5 and 6. Of course, the location of both cylinder assemblies on opposite sides of the upright either partially or wholly behind the respective sides of the upright, depending upon the particular upright design, improves substantially the visibility through the upright over prior four-stage upright designs.

Figure 2A:
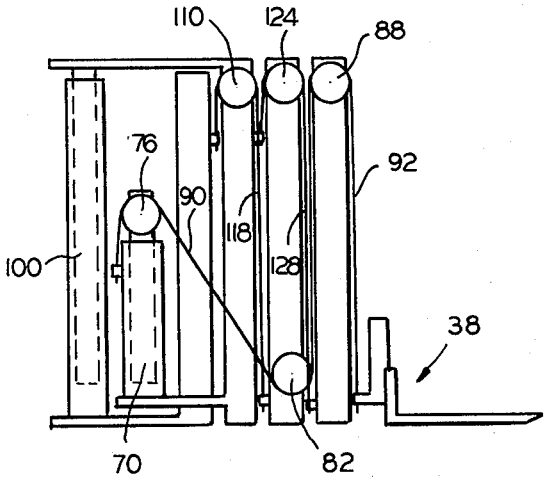
FIGS. 2A, 2B and 2C comprise a series of schematic representations of the upright in various stages of operation.
Figure 2C:
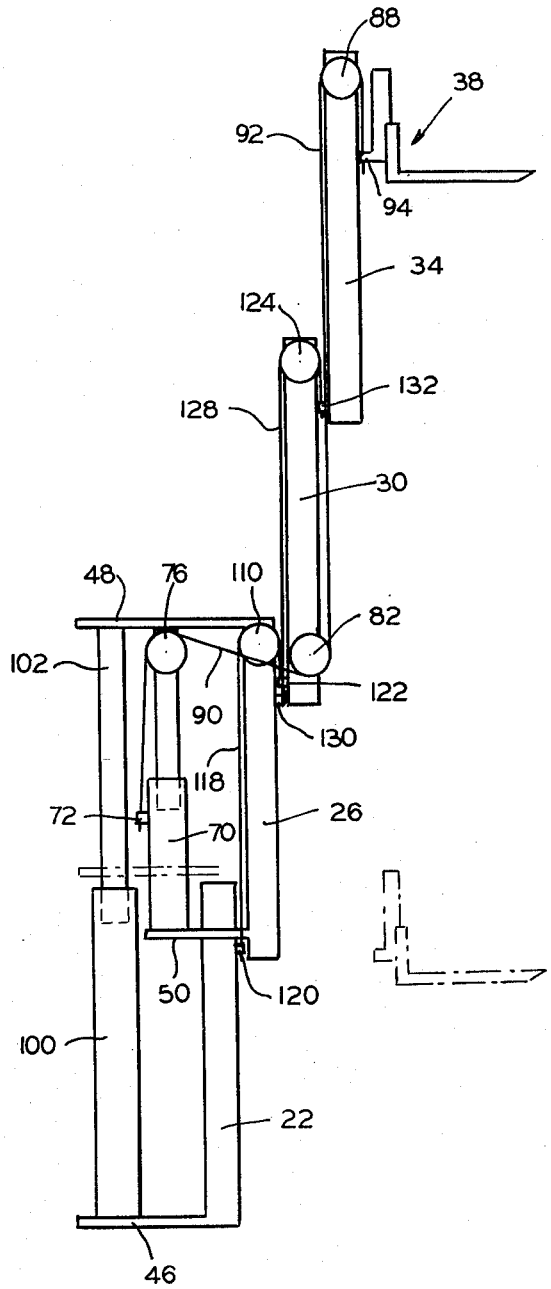
Figure 2B:
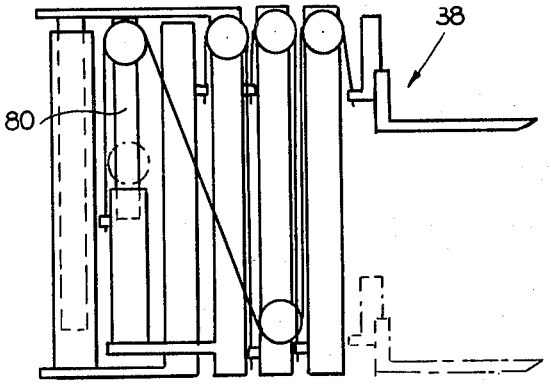

It will be appreciated that in operation the load carriage 38 is elevated at a 2:1 movement ratio to its free-lift position (FIG. 2B) by primary cylinder assembly 70, following which sequential operation of cylinder assembly 100 occurs automatically, i.e., assuming that cylinder assemblies 70 and 100 are of the same diameter, cylinder 100 extension occurs sequentially and automatically following full extension of cylinder 70. This operation results from the greater total weight supported by cylinder 100 than is supported by cylinder 70 so that cylinder 70 extends first. The additional weight supported by cylinder 100 is represented essentially by cylinder assembly 70 plus upright sections 26, 30 and 34 and chains and sprockets. Operation of cylinder assembly 100 extends together the three telescopic sections 26, 30 and 34 to maximum elevation (FIG. 2C) while cylinder 70 is elevated with upright section 26 through the FIG. 6 position to its raised position at maximum upright elevation.

The location of cylinder assembly 70 at one side of the upright is in part able to be effected by the use of twist coupling 96 between chain portions 90 and 92 thereby enabling a change in direction of the chain reeving from the location of chain 90 in the aforementioned intermediate or biased plane to the location of chain 92 in the central longitudinal plane of the upright.

Figure 7:
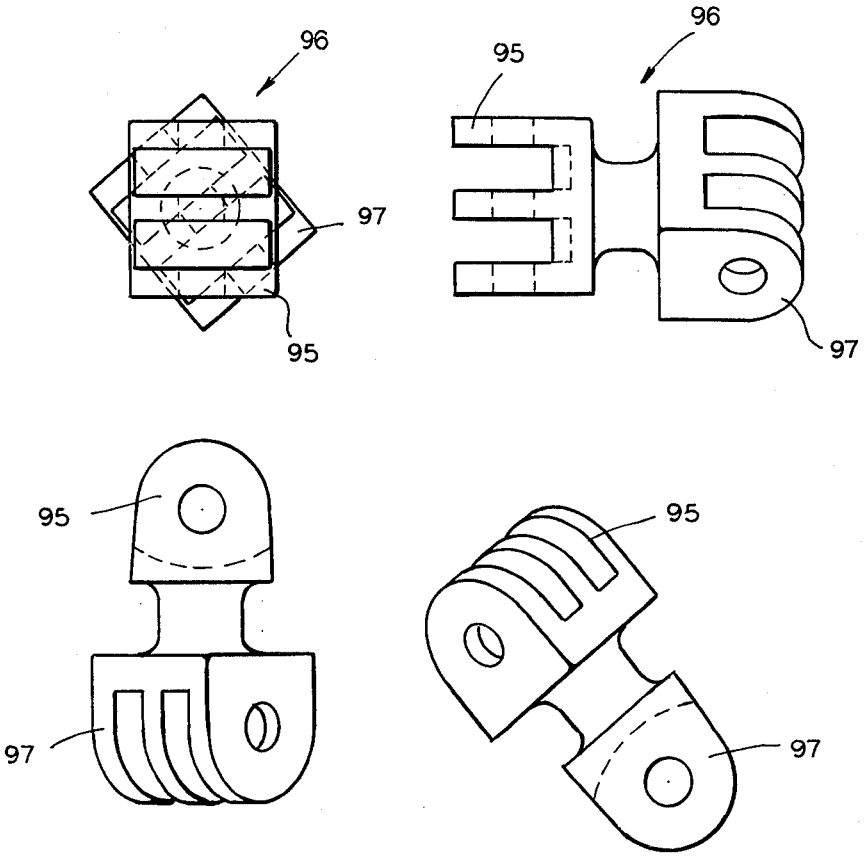
FIG. 7 comprises a group of projected views of a swivel link for use between lengths of chain to permit the lengths to be related at any designed angle to each other.

An exemplary design of such a twist chain link or swivel coupling is shown in FIG. 7 wherein the swivel link connects the one end of chain portion 90 to the adjacent one end of chain portion 92 so that the chain portions may operate in different planes relative to the upright; i.e., chain portion 92 operates in a plane longitudinal of the upright and chain portion 90 operates in a bias plane intermediate the longitudinal and transverse planes of the upright as best shown in FIG. 5. In general, swivel or twist link 96 comprises a pair of chain link connectors 95 and 97 related to each other at 45° in the various planes of projection, as shown, for the purpose described. Of course, depending upon design requirements the connectors 95 and 97 can be related to each other at any preselected angle. It will also be noted that the portion of the chain which includes the coupling 96 is not required to pass over any sprocket so that it does not interfere with a smooth and continuous lifting operation.

Substantial force-moment equilibrium in the transverse planes of this upright assembly requires certain relationships as follows:

(1) the primary lifting chain portion 92 must be connected to the load carrier 38 substantially in the central vertical plane of the load carrier;

(2) Lifting chain 128 of inner upright section 34 must lift and be anchored to said inner section on the same side of and at a transverse distance from the central vertical longitudinal plane of the upright which is equal to one-half the distance in a transverse direction of the location of the vertical axis of that portion of chain 90 reeved between sprockets 76 and 82. In the upright design as disclosed the said portion of chain 128 is located in the central vertical plane of the upright so that the chain anchor 132 which fixes chain 128 to the inner section is also positioned in said central vertical plane of the upright;

(3) lift cylinder assembly 70 must be fixed at its base 74 to the first intermediate upright section 26 and at its piston rod end to a chain sprocket such as 76 over which the primary lift chain portion 90 is reeved. The connection of sprocket 82 to the lower tie bar 54 of second intermediate upright section 30 must be such that the vertical axis of that portion of the chain 90 reeved between sprockets 76 and 82 is located on the opposite side of and at a transverse distance from the central vertical plane of the upright which is equal approximately to twice the transverse distance between chain anchor 122 on second intermediate upright section 30 and chain anchor 130 on the first intermediate upright section 26; and (4) the intermediate chain 118 must be fixed at one end to upright section 30 at anchor 122 and anchored at its other end at 120 to the outer upright section 22 at a location laterally outwardly of cylinder assembly 100 such that the vertical axis of cylinder 100 may be located on the same side of the central vertical plane of the upright and at a transverse distance which is approximately equal to two-thirds of the transverse distance of chain anchor 120 from said central plane of the upright.

Cylinder assembly 70 may be located as the design may require, preferably away from the central vertical plane of the upright and outside of the operator's visibility window, so long as the above conditions are satisfied. The specific location of cylinder 70 will be a function of the force-moment relationships only if the effects of the dead weights of the upright members themselves are taken into account. The actual locations of the lift cylinder assemblies and chains may be altered if force-moment equilibrium to include minor weight effects of upright components is desired in any given design.

References made in the Specification and claims hereof to the longitudinal plane of one side of the upright, or of the transverse planes of the upright, or terms of similar import, shall have the following meanings:

The longitudinal plane of one side of the upright shall mean a three-dimensional vertical plane extending longitudinally of the upright assembly bounded by the outer and inner surfaces of the vertical rail assembly on one side of the upright, while a transverse plane or the transverse planes of the upright shall means any two-dimensional vertical plane or planes extending transversely of the upright assembly in the area bounded by the front and rear surfaces of the vertical rail assemblies of the upright comprising the assembled upright sections.

It will be understood by persons skilled in the art that many design variations in upright designs than those identified and described above may be found to be feasible without departing from the scope of my invention. For example, although the basic design of the upright which is disclosed in all embodiments herein as being of the off-set I-beam roller mounted design is preferred because of the space provided behind the rear flanges or flanges of the I-beam vertical rails for partial nesting of the asymmetric cylinders therein, among other reasons, it will be appreciated that the invention may be also used with other known upright designs, including coplanar (not offset) upright sections having roller mounted channels or I-beams, or fully nested roller mounted I-beams inside of outer channels, and the like.

Depending upon such factors as the axial distance of the operator from the upright, or the transverse position of the operator when seated or standing in a normal operating position on different lift truck types, the most desirable precise locations of the asymmetric cylinder assemblies based upon the various factors will be established. In this connection, it will be understood that the asymmetric cylinder assemblies may in different sizes and designs of uprights desirably project partially into both the longitudinal and transverse planes of of both sides of the upright, as in fact is the case in the embodiment disclosed herein wherein the asymmetric cylinder assemblies 70 and 100 project respectively into both such planes on both sides of the upright (FIG. 5).

Before the particulars of any given upright design are finalized, including its relationship to the normal operator's position in driving the truck, it is important that within the universe of available design variations the asymmetric cylinder assemblies be located such that said cylinder assemblies project at least partially, and preferably substantially, into the area of interference by the adjacent side of the upright when in a retracted or collapsed position with the visibility of the operator from his normal line of sight through that side of the upright.

The designer of uprights of various widths, depths, seat locations, and the like may choose any one of a number of viable combinations of structure within the scope of my invention. It should be therefore understood that recitations in the claims hereof relating to the substantial or approximate balance of force-moments in the upright or to the asymmetric position of a cylinder or cylinders shall be interpreted to include a range of positions of the cylinder or cylinders which best effects the desired result of good operator visibility through the upright and adequately balanced force-moments acting on the upright.

The design is such that the location of the cylinder assemblies at opposite sides of the upright combines with the location of the operator to provide a normal line of sight through the upright at a predetermined designed operator's position and attitude for normal operation of the lift truck so that the cylinder assembly or assemblies at one or both sides of the upright interferes a relatively small amount or not at all with the operator's visibility through the respective side of the upright. In other words, the cylinder assembly or assemblies project at least partially into the area or areas of interference by the adjacent side or sides of the upright when in a retracted or collapsed position with the visibility of the operator from his normal line of sight through the respective side of the upright.

In a relatively wide upright, for example, and with the operator located relatively close to the upright in a forward direction it may be found advantageous to locate the two asymmetric cylinders further forwardly than is shown, thereby necessitating also a relocation of the cylinders transversly inwardly of the upright and out of the longitudinal plane of the respective sides of the upright.

Although I have illustrated only one embodiment of my invention, it will be understood by those skilled in the art that many modifications, such as are discussed above, may be made in the structure, form, and relative arrangement of parts without departing from the spirit and scope of the invention. Accordingly, I intend to cover by the appended claims all such modifications which properly fall within the scope of my invention.

I claim:

1. An upright structure having vertical rails for lift trucks and the like having a fixed upright section, a plurality of telescopic upright sections mounted from said fixed section for simultaneous elevation relative to each other and to said fixed section and load carrier means mounted from one of said telescopic sections for elevation relative thereto, the improvement comprising a first lift cylinder means connected to a movable cylinder support means on one of the telescopic sections other than the telescopic section which is adapted to be actuated to maximum elevation, and a second lift cylinder means connected to a fixed cylinder support means, said first cylinder means being operatively connected to said load carrier means, and said second cylinder means being operatively connected to said plurality of telescopic upright sections, said first and second cylinder means being located substantial distances toward opposite lateral sides of the upright structure so that each said cylinder means projects at least partially into an area of visual interference defined by respective adjacent vertical rails, said visual interference corresponding to the visual interference of the operator's normal line of sight, said normal line of sight being defined when the operator is located in a predetermined designed position and attitude for normal operation of the lift truck.

2. An upright structure as claim in claim 1 wherein said telescopic upright sections comprise a first telescopic section mounted for elevation relative to said fixed section, a second telescopic section mounted for elevation relative to said first telescopic section, a third telescopic section mounted for elevation relative to said second telescopic section, said load carrier means being mounted from said third telescopic section for elevation relative thereto.

3. An upright structure as claimed in claim 2 wherein said first mentioned cylinder support means is located on said first telescopic section.

4. An upright structure as claimed in claim 3 wherein a relatively short fluid pressure conduit connects the base ends of said first and second lift cylinder means.

5. An upright structure as claimed in claim 4 wherein said conduit is located behind the one side of the upright outside of the visibility window through the upright.

6. An upright structure as claimed in claim 4 wherein said conduit is guided during upright elevation between said fixed and first telescopic upright sections.

7. An upright structure as claimed in claim 2 wherein first flexible lifting means operatively connects said first cylinder means to said load carrier means for elevating the latter independently of said second cylinder means, and second flexible lifting means operatively connects said second cylinder means to said plurality of telescopic sections.

8. An upright structure as claimed in claim 7 wherein said first and second flexible lifting means comprise chains reeved in the upright, said first chain being reeved first in a direction generally diagonal of the upright and then longitudinally of the upright.

9. An upright structure as claimed in claim 7 wherein said first flexible lifting element is secured at its one end adjacent one side of said first cylinder means and is secured at its opposite end substantially in the central vertical longitudinal plane of the upright.

10. An upright structure as claimed in claim 9 wherein said second flexible lifting means has one end portion secured to one of said telescopic sections substantially in the central vertical longitudinal plane of the upright.

11. An upright structure as claimed in claim 7 wherein said second flexible lifting means comprises chain means reeved in the upright in a direction substantially transverse of the upright structure.

12. An upright structure as claimed in claim 7 wherein with the upright structure in a retracted condition the operator's normal visibility or line of vision through the central portion of the upright is generally unimpeded except by a single width of flexible lifting element in the central vertical plane of the upright.

13. An upright structure as claimed in claim 7 wherein the operative connection of said cylinder assemblies and of said first and second flexible lifting means in the upright structure is such that at least approximately balanced lifting force-moments act upon the upright structure in transverse planes of the upright at least when a load is carried substantially centrally thereof.

14. An upright structure as claimed in claim 7 wherein said first flexible lifting means is reeved on first, second and third wheel elements connected respectively to said first cylinder means, to the lower end portion of one of said telescopic sections and to the upper end portion of another of said telescopic sections.

15. An upright structure as claimed in claim 14 wherein the first and second wheel elements are mounted on a bias to a transverse plane of the upright and are located in substantial longitudinal rotating alignment for reeving said first flexible lifting means, and said third wheel element is mounted for rotation on a substantially transverse axis for connecting said first flexible means to said load carrier means, a twist coupling means being located in said first flexible lifting means.

16. An upright structure as claimed in claim 14 wherein said second flexible lifting means is reeved on individual wheel means supported both from said first and second telescopic sections, said second flexible lifting means comprising two flexible lifting elements reeved independetly on said individual wheel means.

17. An upright structure as claimed in claim 16 wherein said second flexible lifting means is connected at its various opposite ends to said fixed upright section and to said first, second and third telescopic sections other than the one which is adapted to be actuated to maximum elevation.

18. An upright structure as claimed in claims 16 or 17 wherein the locations of said first and second cylinder means and of said plural wheel elements and flexible lifting means are in such relation to the upright structure and to each other that the force-moments in a transverse plane of the upright are in substantial balance.

19. An upright structure as claimed in claim 7 wherein a fixed one end of said second flexible lifting means is anchored at a distance substantially outwardly of one side only of said second cylinder means.

20. An upright structure as claimed in claim 19 wherein said fixed one end of said second flexible lifting means is located at a distance from the central vertical plane of the upright which is substantially 3/2 of the distance between said central vertical plane and the vertical axis of said second cylinder means.

21. An upright structure as claimed in claim 1 wherein said first cylinder means first elevates said load carrier means relative to said plurality of retracted telescopic sections and said second cylinder means then operates to elevate said plurality of telescopic sections.

22. An upright structure as claimed in claim 1 wherein the retracted height of said first cylinder means is equal substantially to one-half the retracted height of the upright structure and the retracted height of the second cylinder means is equal substantially to the height of the retracted upright structure.

23. An upright structure as claimed in claim 1 wherein said first lift cylinder means projects at least partially into the longitudinal plane of one side of the upright.

24. An upright structure as claimed in claim 23 wherein said second cylinder means projects at least partially into the longitudinal plane of the opposite side of the upright.

25. An upright structure as claimed in claim 23 wherein said first lift cylinder means projects also into a transverse plane of the upright.

26. An upright structure having vertical rails for lift trucks and the like having a fixed upright section, a plurality of telescopic upright sections mounted from said fixed section for simultaneous elevation relative to each other and to said fixed section and load carrier means mounted from one of said telescopic sections for elevation relative thereto, the improvement comprising a first lift cylinder means connected to a movable cylinder support means on one of the telescopic sections other than the telescopic section which is adapted to be actuated to maximum elevation, and a second lift cylinder means connected to a fixed cylinder support means, said first cylinder means being operatively connected to said load carrier means, and said second cylinder means being operatively connected to said plurality of telescopic upright sections.

27. An upright structure as claimed in claim 26 wherein said telescopic upright sections comprise a first telescopic section mounted for elevation relative to said fixed section, a second telescopic section mounted for elevation relative to said first telescopic section, a third telescopic section mounted for elevation relative to said second telescopic section, said load carrier means being mounted from said third telescopic section for elevation relative thereto.

28. An upright structure as claimed in claim 27 wherein said first mentioned cylinder support means is located on said first telescopic section.

29. An upright structure as claimed in claim 28 wherein a relatively short fluid pressure conduit connects the base ends of said first and second lift cylinder means.

30. An upright structure as claimed in claim 27 wherein first flexible lifting means operatively connects said first cylinder means to said load carrier means for elevating the latter independently of said second cylinder means, and second flexible lifting means operatively connects said second cylinder means to said plurality of telescopic sections.

31. An upright structure as claimed in claim 30 wherein a fixed one end of said second flexible lifting means is anchored at a distance substantially outwardly of one side only of said second cylinder means.

32. An upright structure as claimed in claim 31 wherein said fixed one end of said second flexible lifting means is located at a distance from the central vertical plane of the upright which is substantially 3/2 of the distance between said central vertical plane and the vertical axis of said second cylinder means.

* * * * *